United States Patent [19]

Seener et al.

[11] Patent Number: 4,852,364

[45] Date of Patent: Aug. 1, 1989

[54] EXPANSION AND CHECK VALVE COMBINATION

[75] Inventors: G. Thomas Seener; Dennis L. Hoehne, both of St. Louis, Mo.

[73] Assignee: Sporlan Valve Company, St. Louis, Mo.

[21] Appl. No.: 113,135

[22] Filed: Oct. 23, 1987

[51] Int. Cl.[4] ..... F25B 41/04

[52] U.S. Cl. ..... 62/225; 62/324.1; 62/528; 251/282

[58] Field of Search ..... 62/222, 223, 224, 225, 62/504, 528, 324.1; 251/43, 45, 46, 282

[56] References Cited

U.S. PATENT DOCUMENTS

| | | | |
|---|---|---|---|
| 2,786,336 | 3/1957 | Lange | 62/8 |
| 3,699,778 | 10/1972 | Orth | 62/225 |
| 3,738,573 | 6/1973 | Eschbaugh | 236/92 B |
| 3,742,722 | 7/1973 | Leimbach | 62/225 |
| 4,095,742 | 6/1978 | Schumacher | 62/225 X |
| 4,106,691 | 8/1978 | Nielsen | 62/528 X |
| 4,606,199 | 8/1986 | Gotzenberger | 62/225 |

*Primary Examiner*—Lloyd L. King

*Attorney, Agent, or Firm*—Cohn, Powell & Hind

[57] ABSTRACT

This expansion valve includes a valve body providing an inlet chamber and an outlet chamber separated by a compound valve. The compound valve includes a check valve seat defining a valve port receiving a check valve element and the check valve element includes a control valve port receiving a control valve element. During normal refrigerant flow conditions when the pressure in the inlet chamber is greater than the pressure in the outlet chamber, the check valve remains seated while the control valve element meters refrigerant flow between the two chambers. During reverse refrigerant flow, when the pressure in the inlet chamber is less than the pressure in the outlet chamber, the check valve is urged away from the check valve seat to provide for relatively unrestricted refrigerant flow between the two chambers.

11 Claims, 2 Drawing Sheets

FIG. 7.
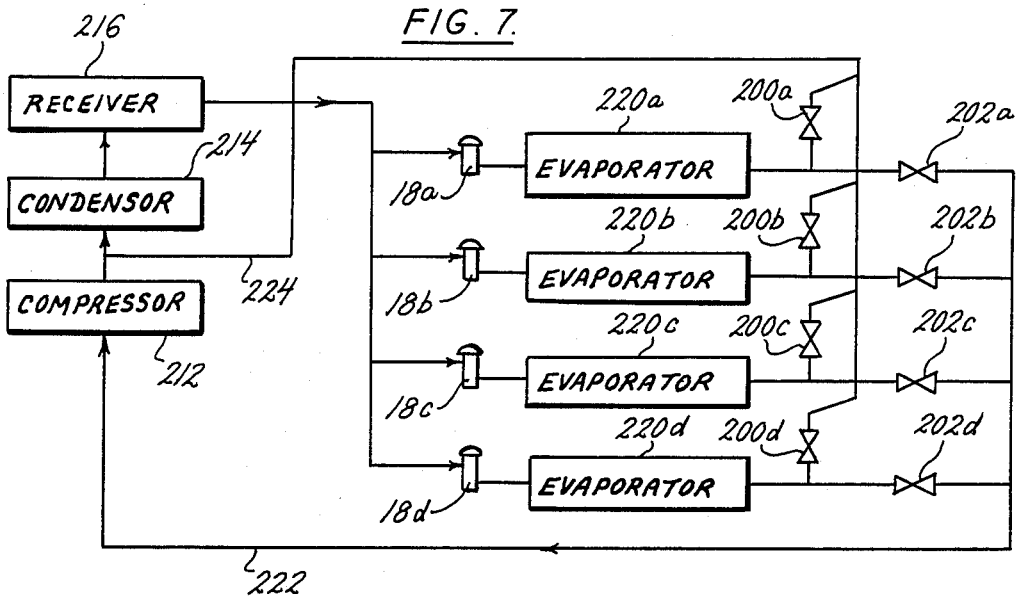
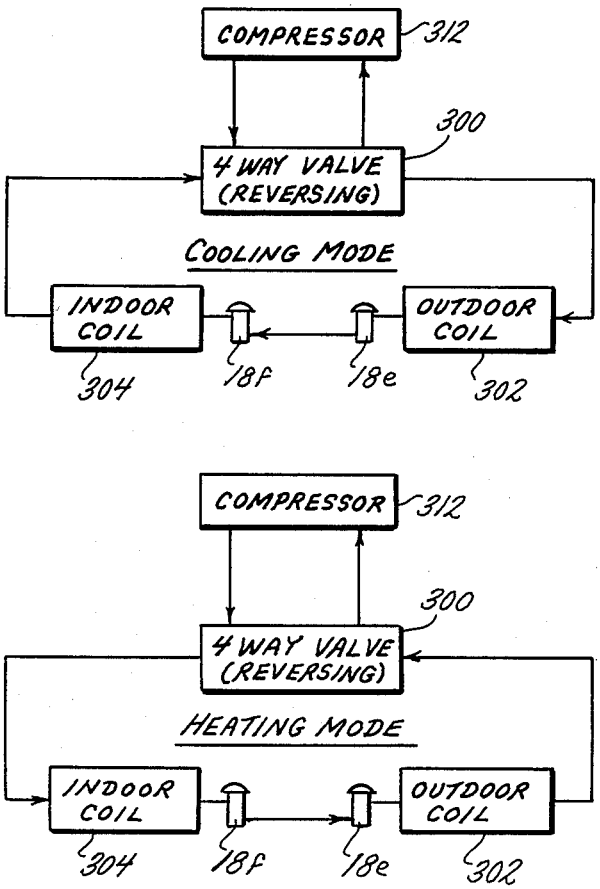
FIG. 8.

EXPANSION AND CHECK VALVE COMBINATION

BACKGROUND OF THE INVENTION

This invention relates generally to expansion valves in refrigeration and air conditioning systems and in particular to an improved expansion valve which incorporates a reverse flow check valve.

Expansion valves are used in refrigerator and air conditioner systems as flow control devices which restrict the flow of liquid refrigerant as it passes from the condensor to the evaporator. Essentially, expansion valves control the flow of liquid refrigerant so that it arrives at the evaporator at a uniform rate consistent with the heat transfer capability of the evaporator coil.

Such expansion devices fall generally into two categories, namely fixed orifice devices and variable orifice valves. In addition, variable orifice valves themselves may be separated into two general classes namely automatic valves and thermostatic valves.

Thermostatic expansion valves are disclosed in U.S. Pat. No. 2,786,336 (H. T. Lange), U.S. Pat. No. 3,742,722 (Leimbach) and U.S. Pat. No. 3,738,573 (Eschbaugh). The first two of these three patents are assigned to the owner of the present invention. U.S. Pat. No. 2,786,336 is directed to providing an expansion valve which compensates for any increased pressure differential across the valve port, for any increased pressure unbalance of the valve port, and for any increased of suction temperature caused as the valve throttles, upon an,° increase, of valve inlet or head pressure. U.S. Pat. No. 3,742,722 is directed to providing an expansion valve in which the valve member is pressure balanced by way of an orifice therethrough which communicates the inlet port with a chamber defined by the valve housing and valve member, the inlet pressure thus acting on equal areas on opposite sides of the valve member. Finally, U.S. Pat. No. 3,738,573 is directed to the provision of an expansion valve of pressure balanced construction for controlling flow in both large and small units.

In some refrigeration and air conditioning systems, and heat pumps represent a prime example, it is necessary to provide for reverse refrigerant flow in the system. If any of the known expansion valves, such as those discussed above, are used in the system it is necessary to provide parallel piping for an independent check valve in addition to the expansion valve. In the normal forward flow direction, the check valve closes and refrigerant flow is directed through the expansion valve. In the reverse flow direction, the check valve opens to allow refrigerant to by-pass the expansion valve.

Systems of this kind are not only cumbersome but tend to be expensive and the present invention solves this problem in a manner not disclosed in the known prior art.

SUMMARY OF THE INVENTION

This invention provides an expansion valve capable of controlling flow between a condenser and an evaporator and when flow is normal and incorporates a built-in check valve for permitting reverse flow through the expansion valve when the expansion feature is not required without requiring an expansion valve by-pass.

It is an object of this invention to provide a valve body having first (inlet) and second (outlet) chambers separated by a compound valve, said valve including a seating means defining a check valve port, a movable check valve element having a control valve port, and a control valve element movable into and out of the check valve port. The check valve is urged into engagement with the seating means and the control valve regulates flow between said first and second chambers when refrigerant flow is normal. The check valve is urged out of engagement with said seating means when refrigerant flow is reversed so that refrigerant flows relatively freely from said second chamber to said first chamber. The valve includes means controlling movement of the control valve element when refrigerant flow is normal.

It is another object of this invention to provide a valve controlling means which includes a pressure responsive motor means in the form of a diaphragm assembly and means subjecting the diaphragm to a control pressure.

It is still another object of this invention to provide connecting means between the diaphragm and the control valve element in the form of an elongate stem connected to the diaphragm at one end and being integrally formed with the control element at the other end.

It is another object of the invention to provide that the check valve element includes a hollow member having a side wall apertured to communicate with the first (inlet) chamber and an end wall apertured to provide the control valve port communicating with the second (outlet) chamber.

Yet another object of the invention is to provide an annular chamber disposed about the stem and sealing the first (inlet) chamber from the diaphragm chamber.

An object of this invention is to provide an expansion valve which can be used in a reversible refrigeration system, such as a heat pump, with a minimum of additional piping and valving.

BRIEF DESCRIPTION OF THE DRAWINGS

FIG. 7 is a diagrammatic view of a multiplex refrigeration system utilizing the invention, and FIG. 8 is a diagrammatic view of a heat pump system utilizing the invention.

DESCRIPTION OF THE PREFERRED EMBODIMENT

Figure 1:
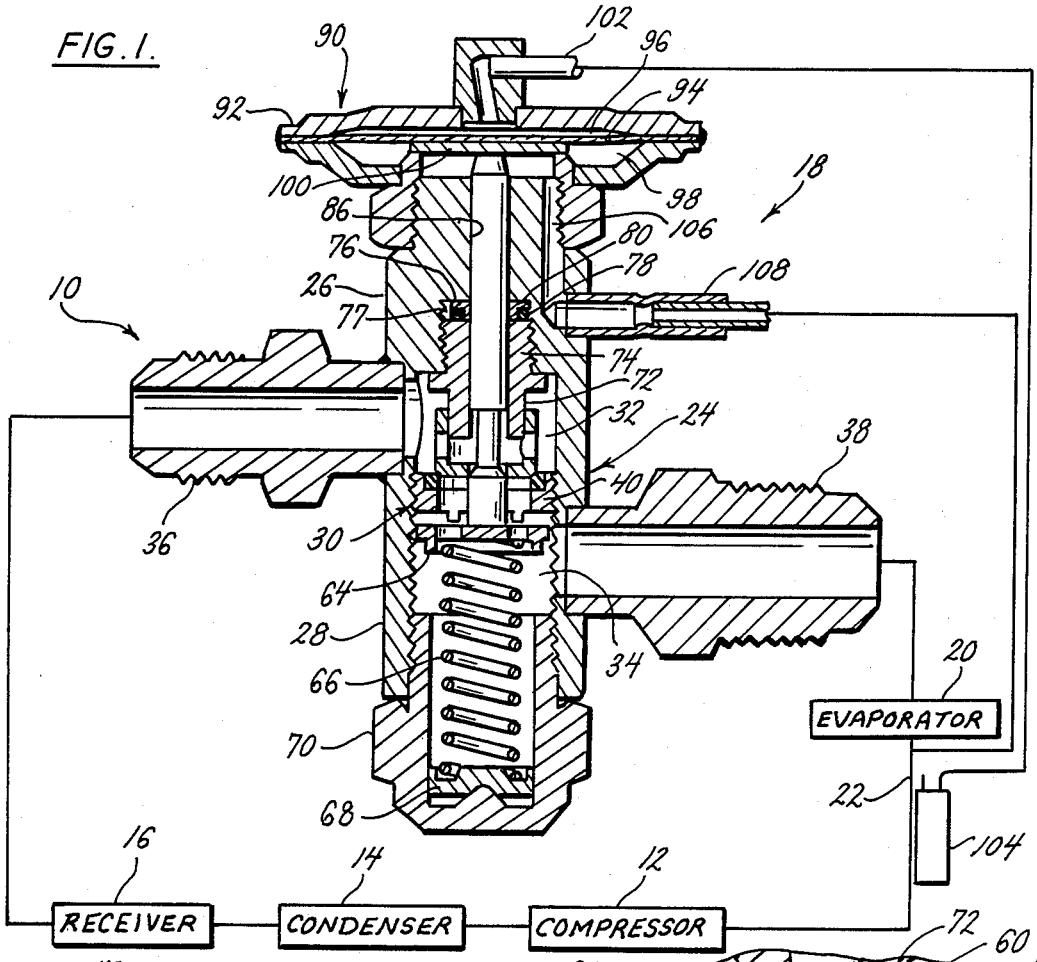
FIG. 1 is a longitudinal cross section through the expansion valve as used in a conventional refrigeration system.
Figure 5:
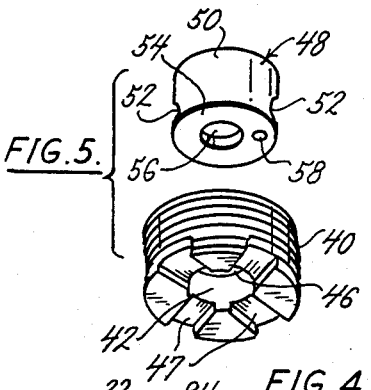
FIG. 5 is an exploded perspective view of the adjustable partition member and check valve element.
Figure 6:
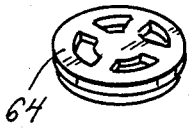
FIG. 6 is a perspective view of the upper spring retainer.

Referring now by reference numerals to the drawings and first to FIG. 1 it will be understood that a refrigeration system 10 is illustrated, in part schematically and is generally indicated by numeral 10. The refrigeration system includes a compressor 12, which, under normal flow conditions, receives refrigerant vapor at a relatively low pressure and delivers it to a condenser 14 at relatively high pressure. The condenser, 14 liquifies the refrigerant and delivers it by way of a receiver 16 to a thermostatic expansion valve 18 at relatively high pressure. The expansion valve controls flow of the liquid refrigerant from the receiver 16 and delivers it to an evaporator 20 at relatively low pressure for evaporation. From the evaporator 20 the refrigerant vapor is delivered, by virtue of a suction line 22 to the compressor 12 to complete the conventional refrigeration cycle. The structural arrangement of parts of the expansion valve 18 incorporates a check valve function which permits reverse flow through the expansion valve 18, and will now be described in detail with reference to FIGS. 1–4.

Figure 2:
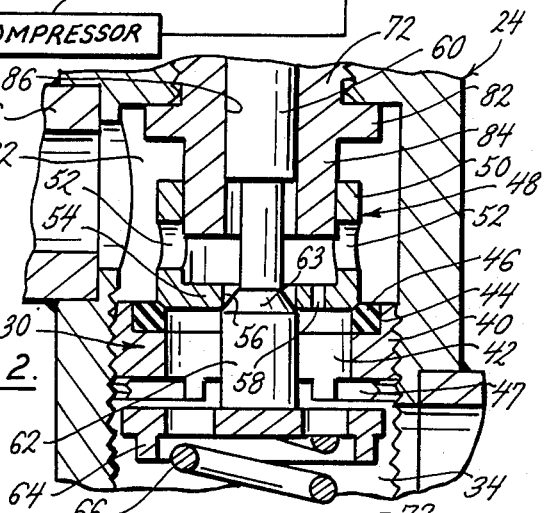
FIG. 2 is an enlarged, fragmentary cross sectional view showing the disposition of parts during normal flow with higher pressure at the expansion valve inlet.
Figure 4:
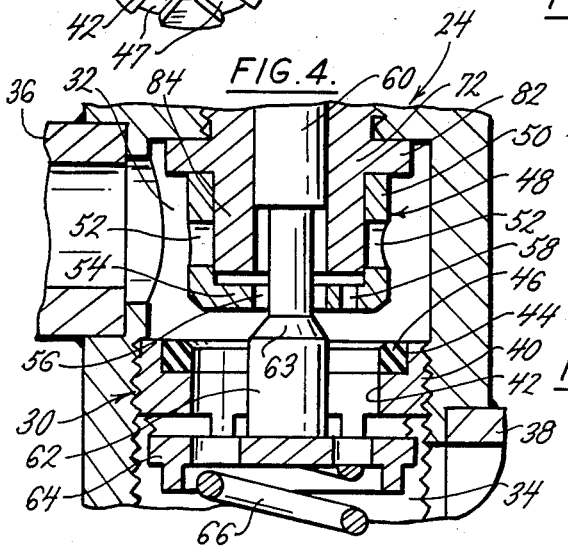
FIG. 4 is similar to FIG. 2 showing the disposition of parts with higher pressure at the outlet fitting than the inlet fitting during reverse refrigerant flow.

The thermostic expansion valve 18 includes a body 24 which is divided into upper and lower portions 26 and 28 by a partition means generally indicated by 30, said upper and lower portions defining, generally, first and second chambers 32 and 34 respectively. Under normal flow conditions the first chamber is an inlet chamber and the second chamber is an outlet chamber and liquid refrigerant is delivered to the inlet chamber 32 at relatively high pressure from the inlet fitting 36 and leaves the outlet chamber 34 by way of the outlet fitting 38 at relatively low pressure As best shown in FIG. 2, the partition means 30 is formed, in part, by a replaceable threaded element 40 having a passage 42 therethrough which is counter-bored at the upper end 44 to receive a sealing ring 46 and includes access notches 47 at the lower end. The sealing ring 46 defines a check valve port and the notches 47 facilitate refrigerant flow. The partition means 30 is also formed, in part, by a moveable check valve element 48 which includes a cylindrical wall 50 having inlet apertures 52 and an end wall 54 having an outlet aperture 56, constituting a control valve port. An offset bleed port 58 is useful under some circumstances but is not necessary under all circumstances and may therefore be considered as optional. Under normal flow conditions, the outer circular margin of the check valve element end wall 54 is seated on the sealing ring 44 and maintained in closed position shown in FIG. 2, by the pressure differential between the inlet and outlet chambers 32 and 34.

A control valve element 62 is unitarily formed at the lower end of an elongate valve stem 60, said stem including a tapered portion 63 which is received with the valve aperture 56. The control valve element 62 is seated on an apertured spring retainer 64 which receives the upper end of a superheat spring 66, the lower end of said spring being received by a lower retainer 68. In the embodiment shown, the lower retainer 68 is received within a passage formed in a closure member 70, which is threadedly connected to the body lower portion 28 in adjustable relation in the conventional manner. The notched lower end of the threaded partition member 40 provides a stop limiting upward movement of the upper spring retainer 64.

The body 24 includes a guide member 72 having an upper end portion 74 threadedly received within a counterbored portion of the body upper portion 26. The counterbored portion defines an abutment face 76 and said guide member upper end 74 is spaced from said abutment 76 to define a sealed chamber 77 having a cooperating O-ring seal 78, and a cup washer seal 80 disposed therewithin.

In the preferred embodiment the washer seal 80 is of Teflon or similar material of low friction coefficient so that the stem 60 slides easily against the vertical leg of said washer which it engages in sealing relation The horizontal leg of the cup washer seal 80 engages the abutment face 76 in sealing relation so that there is no upward leakage of refrigerant liquid from the inlet chamber 32 beyond the sealed chamber 77. As will be readily understood the combination O-ring/cup washer seal effectiveness is increased as the head pressure in the inlet chamber 32 is increased.

The guide member 72 includes an intermediate, annular stop member 82 and the guide member lower end 84 receives the check valve 48 in guided relation as it moves away from the seating ring 46 under reverse flow conditions during which the pressure on the underside of the check valve element 48 is higher than the pressure on the upperside thereof. The body upper portion 26 and guide member 72 cooperate to define a guide passage 86 receiving the stem 60 in guided relation.

A motor assembly 90 is threadedly connected to the upper end of body portion 26. The motor assembly 90 includes a casing 92 providing a housing for a diaphragm 94, and said diaphragm constitutes a motor element. The diaphragm 94 cooperates with the casing 92 to define an upper diaphragm compartment 96 and a lower diaphragm compartment 98. The diaphragm 94 is provided with a follower member 100 which is attached to the upper end of the stem 60 and moves with said diaphragm.

The upper diaphragm compartment 96 communicates with a capillary tube 102 having a thermostatic bulb 104 at the remote end which is disposed in thermal responsive contact relation with the evaporator suction line 22 adjacent the evaporator outlet. A limited charge of refrigerant, e.g. Freon, is introduced into the bulb 104. Below a predetermined temperature at the bulb the charge is partly in liquid phase and partly in vapor phase. Accordingly, the pressure in the upper diaphragm compartment responds to changes in superheat in the suction line 22. The lower diaphragm compartment 98 communicates with an offset equalizer passage 106 formed in the body upper portion 26 which, by means of an external equalizer connection 108, communicates with the evaporator 20 downstream of the inlet of said evaporator, so that said lower compartment experiences substantially the same pressure as said evaporator, at the bulb location.

Because of this structural arrangement of parts, movement of the diaphragm 94 and follower member 100, in response to a change in pressure differential between the upper and lower diaphragm compartments 96 and 98, is transmitted by the valve stem 60 to the valve element 62 and hence to the control valve element 62, such movement being opposed by the superheat spring 66. As will be understood, the stem 60 provides a connection means between the diaphragm 94 and the control valve element 62 and the control valve opening is therefore controlled by the suction line superheat, which affects pressure in the upper diaphragm compartment 96, and by the evaporator pressure, which affects pressure in the lower diaphragm compartment 98. Accordingly, the bulb 104 and the equalizer connection 108 cooperate to provide a means of subjecting the diaphragm to a control pressure. In addition, the control valve opening is affected by the strength of the superheat spring 66 which is chosen to suit the particular system in which the expansion valve 18 is used. In accordance with the invention these factors provide a means of controlling the control valve opening.

In effect, the check valve element 48 and the control valve element 62 constitute a compound valve means which provides a check valve feature or a control valve feature in depending on whether refrigerant flow is normal or reversed.

It is thought that the structural features of this expansion valve have become fully apparent from the foregoing description of parts, but for completeness of disclosure the operation of the valve will be briefly described.

During normal flow conditions the head pressure at the inlet fitting 36 is higher than the evaporator pressure at the outlet fitting 38. Liquid refrigerant entering the expansion valve 18 through the inlet fitting 36 enters the inlet chamber 32, is controlled and metered through the variable annular opening which is defined by the tapered valve portion 63 and the valve port 56 in the check valve end wall 54. The metered and expanded liquid refrigerant, which has flowed through the annular orifice, then flows into the outlet chamber 34 flowing through and around the apertured upper spring retainer 64, and the superheat spring 66, prior to passing through the outlet fitting 38 en route to the evaporator 20. Because of the pressure drop across the check valve element 48, said element is urged against the sealing ring 46 with the result that the liquid refrigerant is forced through the variable orifice and the bleed port 58 (where a bleed port is provided) and the check valve end wall 54 cooperates with the replaceable threaded element 40 so that the two parts function as a unit and said end wall forms a part of the partition means separating the inlet and outlet chambers 32 and 34 respectively.

Figure 3:
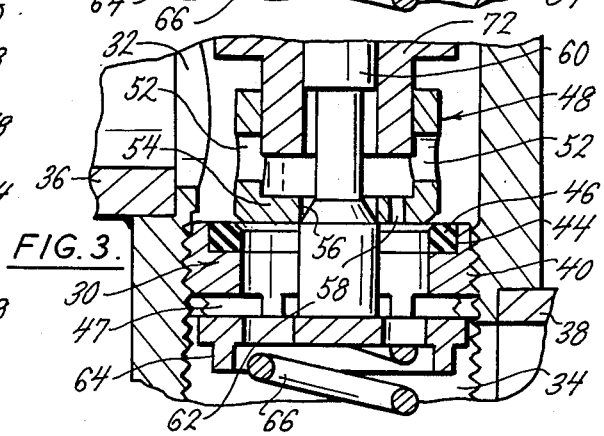
FIG. 3 is similar to FIG. 2 showing an intermediate disposition of parts.

However, when the refrigerant pressure at the valve outlet 34 becomes higher than that of the valve inlet 32, the differential pressure on the check valve end wall 54 urges the check valve element 48 upwardly away from the sealing ring 46. The initial movement is shown in FIG. 3 and said check valve element 48 is guided in its upward path by the guide member 84 until it engages stop 82 and reaches the position shown in FIG. 4. The check valve element 48 is maintained in this position while pressure in the outlet chamber 34 is higher than it is in the inlet chamber 32, that is during reverse flow conditions to permit relatively unrestricted reverse flow between the chambers. When the pressure differential is reversed again and normal flow resumed the check valve element 62 returns to its lower position in which it is seated on the sealing ring 46.

FIG. 7 illustrates a multiplex system utilizing a compressor 212, condensor 214, and receiver 216. In addition, as shown, the system consists of multiple subsystems each utilizing an expansion valve 18 (18a etc.) incorporating the check valve feature and a plurality of evaporators 220 (220*a* etc.). Each sub-system utilizes a gas defrost solenoid valve 200 (200*a* etc.) and a suction stop solenoid valve 202 (202*a* etc.). In the normal flow mode shown, the gas valves are closed and the suction stop valves are open. The expansion valves operate normally and refrigerant vapor at low pressure is passed from the evaporators to the compressor 212 through suction line 222 in the normal way. In the reverse flow mode the suction stop valves are closed, the gas defrost valves are open and the expansion valves are open to route refrigerant through the compressor bypass line 224

FIG. 8 illustrates a heat pump system utilizing the expansion valve 18. As shown, this system includes a compressor 312 which selectively supplies refrigerant to an outdoor coil 302 or an indoor coil 304 depending on whether the system is in a cooling mode or a heating mode.

In the cooling mode refrigerant vapor at high pressure is passed from the compressor 312 by way of the four-way valve 300 to the outdoor coil 302, which acts as a condensor. Refrigerant liquid is passed into expansion valve 18*e* at high pressure and emerges as refrigerant liquid at low pressure This refrigerant is passed through expansion valve 18*f*, which is in an open condition, to an indoor coil 304, which acts as an evaporator. From the indoor coil 304, refrigerant vapor at low pressure is returned by way of the four-way valve 300 to the compressor 312.

In the heating mode refrigerant vapor at high pressure is passed from the compressor 312 by way of the four-way valve 300 to the indoor coil 304, which acts as a condensor. Refrigerant liquid is then passed into expansion valve 18*f* at high pressure and emerges as refrigerant liquid at low pressure This refrigerant is passed through expansion valve 18*e*, which is in an open condition, to the outdoor coil 302, which acts as an evaporator. From the outdoor coil 302 refrigerant vapor at low pressure is returned by way of the four-way valve 300 to the compressor 312. This arrangement eliminates the need to provide a by-pass line, with a separate check valve for the expansion valves since the expansion valves incorporate a check valve.

Although the improved expansion valve has been described by making particularized reference to a preferred expansion valve mechanism, the details of description is not to be understood as restrictive, numerous variants being possible within the principles disclosed and within the fair scope of the claims hereunto appended

We claim as our invention:

1. A combination expansion valve and check valve for controlling the flow of refrigerant in a refrigeration system comprising:

(a) a valve body including an upper portion providing a first chamber and lower portion providing a second chamber said first chamber defining an inlet chamber and said second chamber defining an outlet chamber receiving refrigerant at a lower pressure than the refrigerant pressure in said inlet chamber when refrigerant flow is in a normal direction from said first chamber to said second chamber, (b) compound valve means disposed between said first and second chambers including:

(1.) a seating means defining a check valve port, (2.) a movable check valve element receivable by said seating means, said check valve element including a control valve port, and (3.) a control valve element; movable into and out of said control valve port, (4.) said check valve being urged into engagement with said check valve seating means and said control valve regulating flow between said first and second chambers, when refrigerant flow is normal, and (5.) said check valve element being urged out of engagement with said check valve seating means when refrigerant flow is reversed so that refrigerant flows relatively freely from said second chamber to said first chamber, (c) means for controlling movement of the control valve element when the refrigerant flow is normal.

2. A combination valve as defined in claim 1 in which:

(d) the means controlling movement of the control valve element includes a diaphragm housing attached to the body at one end and defining a diaphragm chamber having a diaphragm therewithin separating said chamber into a first compartment and a second compartment, means subjecting said diaphragm to a control pressure, and connecting means operatively connecting said diaphragm and said control valve element to control movement of said control valve element when refrigerant flow is normal.

3. A combination valve as defined in claim 2, in which:

(e) the means subjecting said diaphragm to a control pressure includes a means for subjecting said first diaphragm compartment to a vapor pressure responsive to temperature at the evaporator outlet.

4. A combination valve as defined in claim 2, in which:

(e) the means subjecting said diaphragm to a control pressure includes means for subjecting the second diaphragm compartment to evaporator pressure.

5. A combination valve as defined in claim 2, in which:

(e) the means subjecting said diaphragm to a control pressure includes a thermostatic bulb located at the evaporator outlet and having a fluid charge communicating with the first compartment and a passage in the valve body operatively communicating between the second diaphragm compartment and the evaporator.

6. A combination valve as defined in claim 2, in which:

(e) the body upper portion includes an elongate passage extending between said diaphragm chamber and said first chamber, and (f) the connecting means includes a stem received by said passage and having one end operatively connected to the diaphragm and the other end operatively connected to the control valve element to transmit movement of the diaphragm to the control valve element.

7. A combination valve as defined in claim 6, in which:

(g) said stem and said valve element are unitarily formed.

8. A combination valve as defined in claim 7, in which:

(h) the body upper portion includes an annular sealing chamber disposed about said stem and having an annular face disposed in perpendicular relation to said stem, said chamber having a combination sealing ring and cup washer disposed therewithin, said cup washer having one wall engageable with said stem and the other wall engageable with said annular face.

9. A combination valve as defined in claim 1, in which:

(d) the valve body includes an annular, relatively fixed partition means having an inner margin providing the seating means, and the check valve element includes by a hollow cylindrical member having an end wall received by said margin, said end wall having an axial opening providing the control valve opening.

10. A combination valv as defined in claim 9, in which:

(e) the body upper portion includes an elongate passage extending between said diaphragm chamber and said first chamber and a guide member disposed in said first chamber, (f) the connecting means includes a stem received by said passage and having one end operatively connected to the diaphragm and the other end operatively connected to the control valve element to transmit movement of the diaphragm to the control valve element, and (g) said hollow cylindrical member is received by said guide member in guided relation as said check valve element moves away from said seating portion.

11. A combination valve as defined in claim 10, in which:

(h) said stem and control valve member are unitarily formed and extend through said check valve element.

* * * * *

UNITED STATES PATENT AND TRADEMARK OFFICE

CERTIFICATE OF CORRECTION

PATENT NO. : 4,852,364

DATED : August 1, 1989

INVENTOR(S) : G. Thomas Seener et al.

It is certified that error appears in the above-identified patent and that said Letters Patent is hereby corrected as shown below:

Column 1, line 32, after an delete ", °".
Column 1, line 32, after increase delete ",".
Column 3, line 68, after "sealing relation" insert --.--.
Column 6, line 55, after element delete ";".
Column 8, line 24, delete "valv" and insert --valve--.

Signed and Sealed this

Second Day of October, 1990

*Attest:*

HARRY F. MANBECK, JR.

*Attesting Officer*

*Commissioner of Patents and Trademarks*